United States Patent [19]

Moskowitz et al.

[11] Patent Number: 5,019,429

[45] **Date of Patent: * May 28, 1991**

[54] HIGH DENSITY THERMAL SPRAY COATING AND PROCESS

[75] Inventors: Larry N. Moskowitz; Donald J. Lindley, both of Naperville, Ill.

[73] Assignee: Amoco Corporation, Chicago, Ill.

[ * ] Notice: The portion of the term of this patent subsequent to Sep. 26, 2006 has been disclaimed.

[21] Appl. No.: 392,451

[22] Filed: Aug. 11, 1989

Related U.S. Application Data

[63] Continuation-in-part of Ser. No. 138,815, Dec. 28, 1987, Pat. No. 4,869,936.

[51] Int. Cl.[5] ..... B05D 3/00

[52] U.S. Cl. ..... 427/422; 427/423

[58] Field of Search ..... 427/422, 423

[56] References Cited

U.S. PATENT DOCUMENTS

| | | | |
|---|---|---|---|
| 3,470,347 | 9/1969 | Jackson | 427/34 |
| 4,370,538 | 1/1983 | Browning | 219/121 |
| 4,416,421 | 11/1983 | Browning | 239/79 |
| 4,869,936 | 9/1989 | Moskowitz | 427/423 |

*Primary Examiner*—Shrive Beck

*Attorney, Agent, or Firm*—Ekkehard Schoettle; William H. Magidson; Ralph C. Medhurst

[57] ABSTRACT

A high density, substantially oxide-free metal layer is deposited by spray deposition on a substrate in an atmosphere containing ambient air having an oxygen content above about 0.1% by weight. This is accomplished by directing a supersonic-velocity jet stream of hot gases carrying metal particles at the substrate through an inert gas shroud. The layer is useful as a corrosion barrier and for repairing metal substrates.

9 Claims, 4 Drawing Sheets

HIGH DENSITY THERMAL SPRAY COATING AND PROCESS

This application is a continuation-in-part of U.S. patent application, Ser. No. 138,815, filed Dec. 28, 1987, and allowed Mar. 22, 1989 now U.S. Pat. No. 4,869,936.

BACKGROUND OF THE INVENTION

This invention relates to thermal spraying and more particularly to improved apparatus for shielding a supersonic-velocity particle-carrying flame from ambient atmosphere and an improved process for producing high-density, low-oxide, thermal spray coatings on a substrate.

Thermal spraying technology involves heating and projecting particles onto a prepared surface. Most metals, oxides, cermets, hard metallic compounds, some organic plastics and certain glasses may be deposited by one or more of the known thermal spray processes. Feedstock may be in the form of powder, wire, flexible powder-carrying tubes or rods depending on the particular process. As the material passes through the spray gun, it is heated to a softened or molten state, accelerated and, in the case of wire or rod, atomized. A confined stream of hot particles generated in this manner is propelled to the substrate and as the particles strike the substrate surface they flatten and form thin platelets which conform and adhere to the irregularities of the previously prepared surface as well as to each other. Either the gun or the substrate may be translated and the sprayed material builds up particle by particle into a lamellar structure which forms a coating. This particular coating technique has been in use for a number of years as a means of surface restoration and protection.

Known thermal spray processes may be grouped by the two methods used to generate heat namely, chemical combustion and electric heating. Chemical combustion includes powder flame spraying, wire/rod flame spraying and detonation/explosive flame spraying. Electrical heating includes wire arc spraying and plasma spraying.

Standard powder flame spraying is the earliest form of thermal spraying and involves the use of a powder flame spray gun consisting of a high-capacity, oxy-fuel gas torch and a hopper containing powder or particulate to be applied. A small amount of oxygen from the gas supply is diverted to carry the powder by aspiration into the oxy-fuel gas flame where it is heated and propelled by the exhaust flame onto the work piece. Fuel gas is usually acetylene or hydrogen and temperatures in the range of 3,000°–4,500° F. are obtained. Particle velocities are in the order of 80–100 feet per second. The coatings produced generally have low bond strength, high porosity and low overall cohesive strength.

High-velocity powder flame spraying was developed about 1981 and comprises a continuous combustion procedure that produces exit gas velocities estimated to be 4,000–5,000 feet per second and particle speeds of 1,800–2,600 feet per second. This is accomplished by burning a fuel gas (usually propylene) with oxygen under high pressure (60–90 psi) in an internal combustion chamber. Hot exhaust gases are discharged from the combustion chamber through exhaust ports and thereafter expanded into an extending nozzle. Powder is fed axially into this nozzle and confined by the exhaust gas stream until it exits in a thin high speed jet to produce coatings which are far more dense than those produced with conventional or standard powder flame spraying techniques.

Wire/rod flame spraying utilizes wire as the material to be deposited and is known as a "metallizing" process. Under this process, a wire is continuously fed into an oxy-acetylene flame where it is melted and atomized by an auxiliary stream of compressed air and then deposited as the coating material on the substrate. This process also lends itself to the use of other materials, particularly brittle ceramic rods or flexible lengths of plastic tubing filled with powder. Advantage of the wire/rod process over powder flame spraying lies in its use of relatively low-cost consumable materials as opposed to the comparatively high-cost powders.

Detonation/explosive flame spraying was introduced sometime in the mid 1950's and developed out of a program to control acetylene explosions. In contrast to the thermal spray devices which utilize the energy of a steady burning flame, this process employs detonation waves from repeated explosions of oxy-acetylene gas mixtures to accelerate powder particles. Particulate velocities in the order of 2,400 feet per second are achieved. The coating deposits are extremely strong, hard, dense and tightly bonded. The principle coatings applied by this procedure are cemented carbides, metal/carbide mixtures (cermets) and oxides.

The wire arc spraying process employs two consumable wires which are initially insulated from each other and advanced to meet at a point in an atomizing gas stream. Contact tips serve to precisely guide the wires and to provide good electrical contact between the moving wires and power cables. A direct current potential difference is applied across the wires to form an arc and the intersecting wires melt. A jet of gas (normally compressed air) shears off molten droplets of the melted metal and propels them to a substrate. Spray particle sizes can be changed with different atomizing heads and wire intersection angles. Direct current is supplied at potentials of 18–40 volts, depending on the metal or alloy to be sprayed; the size of particle spray increasing as the arc gap is lengthened with rise in voltage. Voltage is therefore maintained at the lowest level consistent with arc stability to provide the smallest particles and smooth dense coatings. Because high arc temperatures (in excess of 7,240° F.) are encountered, electric-arc sprayed coatings have high bond and cohesive strength.

The plasma arc gun development has the advantage of providing much higher temperatures with less heat damage to a work piece, thus expanding the range of possible coating materials that can be processed and the substrates upon which they may be sprayed. A typical plasma gun arrangement involves the passage of a gas or gas mixture through a direct current arc maintained in a chamber between a coaxially aligned cathode and water-cooled anode. The arc is initiated with a high frequency discharge. The gas is partially ionized creating a plasma with temperatures that may exceed 30,000° F. The plasma flux exits the gun through a hole in the anode which acts as a nozzle and its temperature falls rapidly with distance. Powdered feedstock is introduced into the hot gaseous effluent at an appropriate point and propelled to the work piece by the high-velocity stream. The heat content, temperature and velocity of the plasma gas are controlled by regulating arc current, gas flow rate, the type and mixture ratio of gases and by the anode/cathode configuration.

Up until the early 1970's, commercial plasma spray systems used power of about 5–40 kilowatts and plasma gas velocities were generally subsonic. A second generation of equipment was then developed known as high energy plasma spraying which employed power input of around 80 kilowatts and used converging-diverging nozzles with critical exit angles to generate supersonic gas velocities. The higher energy imparted to the powder particles results in significant improvement in particle deformation characteristics and bonding and produces more dense coatings with higher interparticle strength.

Recently, controlled atmosphere plasma spraying has been developed for use primarily with metal and alloy coatings to reduce and, in some cases, eliminate oxidation and porosity. Controlled atmosphere spraying can be accomplished by using an inert gas shroud to shield the plasma plume. Inert gas filled enclosures also have been used with some success. More recently, a great deal of attention has been focused on "low pressure" or vacuum plasma spray methods. In this latter instance, the plasma gun and work piece are installed inside a chamber which is then evacuated with the gun employing argon as a primary plasma gas. While this procedure has been highly successful in producing the deposition of thicker coats, improved bonding and deposit efficiency, the high costs of the equipment thus far have limited its use.

Related to the "low pressure" development is U.S. Pat. No. 3,892,882 issued July 1, 1975 to Union Carbide Corporation, New York, N.Y., by which a subatmospheric inert gas shield is provided about a plasma gas plume to achieve low deposition flux and extended stand-off distances in a plasma spray process.

Aside from the few exceptions noted in the heretofore briefly described thermal spraying processes, all encounter some degree of oxidation of coating materials when carried out in ambient atmosphere conditions. In spraying metals and metal alloys, it is most desirable to minimize the pick-up of oxygen as much as possible. Soluble oxygen in metallic alloys increases hardness and brittleness while oxide scales on the powder and inclusions in the coating lead to poorer bonding, increased crack sensitivity and increased susceptibility to corrosion.

BRIEF DESCRIPTION OF THE INVENTION

The discoveries and developments of this invention pertain in particular to high-velocity thermal spray equipment and a process for achieving low-oxide, dense metal coatings therewith. In one aspect, the present invention comprises accessory apparatus preferably attachable to the nozzle of a supersonic-velocity thermal spray gun, preferably of the order developed by Browning Engineering, Hanover, N.H., and typified, for example, by the gun of U.S. Pat. No. 4,416,421 issued Nov. 22, 1983 to James A. Browning. That patent discloses the features of a high-velocity thermal spray apparatus using oxy-fuel (propylene) products of combustion in an internal combustion chamber from which the hot exhaust gases are discharged and then expanded into a water-cooled nozzle. Powder metal particles are fed into the exhaust gas stream and exit from the gun nozzle in a supersonic-speed jet stream.

In brief, the apparatus of this invention comprises an inert gas shield confined within a metal shroud attachment which extends coaxially from the outer end of a thermal spray gun nozzle. The apparatus includes an inert gas manifold attached to the outer end of the gun nozzle, means for introducing inert gas to the manifold at pressures of substantially 200–250 psi, means for mounting the manifold coaxially of the gun's nozzle and a plurality of internal passageways exiting to a series of shield gas nozzles disposed in a circular array and arranged to discharge inert gas in a pattern directed substantially tangentially against the inner wall of the shroud, radially outwardly of the gun's flame jet.

By operating the high-velocity thermal spray gun in accordance with the process of this invention, total volume fractions of porosity and oxide, as exhibited by conventional metallic thermal spray coatings, are substantially reduced from the normal range of 3–50% to a level of less than 2%. The process is performed in ambient atmosphere without the use of expensive vacuum or inert gas enclosures as employed in existing gas-shielding systems of the thermal spraying art. Procedural constraints of this process include employment of metal powders of a narrow size distribution, normally between 10 and 45 microns; the powder having a starting oxygen content of less than 0.18% by weight. Combustion gases utilized in a flame spray gun under the improved process are hydrogen and oxygen which are fed to the combustion chamber at pressures in excess of 80 psi in order to obtain minimum oxygen flow rates of 240 liters/minute and a preferred ratio of 2.8–3.6 to 1, hydrogen to oxygen flow rates. These flow rates establish a distinct pattern of supersonic shock diamonds in the combustion exhaust gases exiting from the gun nozzle, indicative of sufficient gas velocity to accelerate the powder to supersonic velocities in the neighborhood of 1,800–2,600 feet per second. Inert gas carries the metal powder into the high-velocity combustion gases at a preferred flow rate in the range of 48–90 liters/minute. Relative translating movement between gun and substrate is in the order of 45–65 feet per minute with particle deposition at a rate in the order of 50–85 grams/minute. Coatings produced in accordance with this procedure are uniform, more dense, less brittle and more protective than those obtained by conventional high-velocity thermal spray methods.

It is a principle object of this invention to provide a new and improved apparatus for use with supersonic-velocity thermal-spraying equipment which provides a localized inert gas shield about the particle-carrying flame.

Another important object of this invention is to provide an improved attachment for supersonic-velocity thermal spray guns which provides an inert gas shield concentrically surrounding the particle-carrying exhaust gases of the gun and is operable to materially depress oxidation of such particles and the coatings produced therefrom.

Still another object of this invention is to provide a supersonic thermal spray gun with an inert-gas shield having a helical-flow pattern productive of minimal turbulent effect on the particle-carrying flame.

A further important object of this invention is to provide apparatus for effecting a helical-flow, inert gas shield about a high-velocity exhaust jet of a thermal spray gun in which the inert shield gases are directed radially outwardly of the exhaust gases against a confining concentric wall extending coaxially of the spray gun nozzle.

A further important object of this invention is to provide improved apparatus for a high-velocity exhaust jet of a thermal spray gun which provides an inert gas shield about the particle-carrying jet without limiting portability of the spray equipment.

Still a further important object of this invention is to provide an improved process for achieving high-density, low-oxide metal coatings on a substrate by use of supersonic-velocity, thermal spray equipment operating in ambient air.

Another important object of this invention is to provide an improved process for forming high-velocity thermal spray coatings on substrate surfaces which exhibit significant improvements in density, cleanliness and uniformity of particle application.

Having described this invention, the above and further objects, features and advantages thereof will appear from time to time from the following detailed description of a preferred embodiment thereof, illustrated in the accompanying drawings and representing the best mode presently contemplated for enabling those with skill in the art to practice this invention.

DESCRIPTION OF THE PREFERRED EMBODIMENT

The descriptive materials which follow will initially detail the combination and functional relationship of parts embodied in the inert gas shroud apparatus followed by the features of the improved process according to this invention.

APPARATUS

Figure 2:
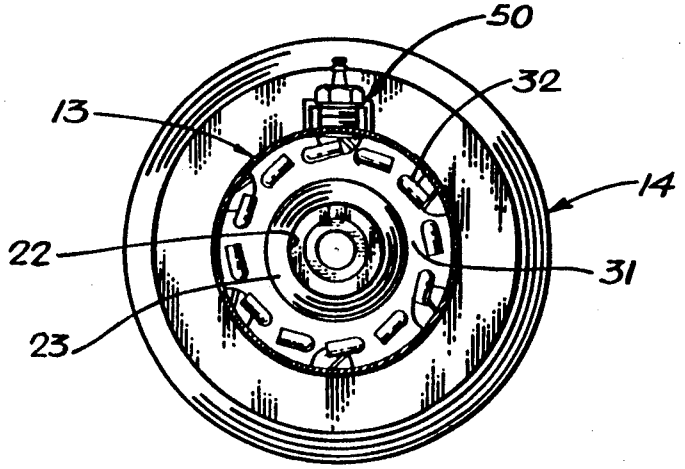
FIG. 2 is an end elevation of the shroud apparatus shown in FIG. 1.
Figure 1:
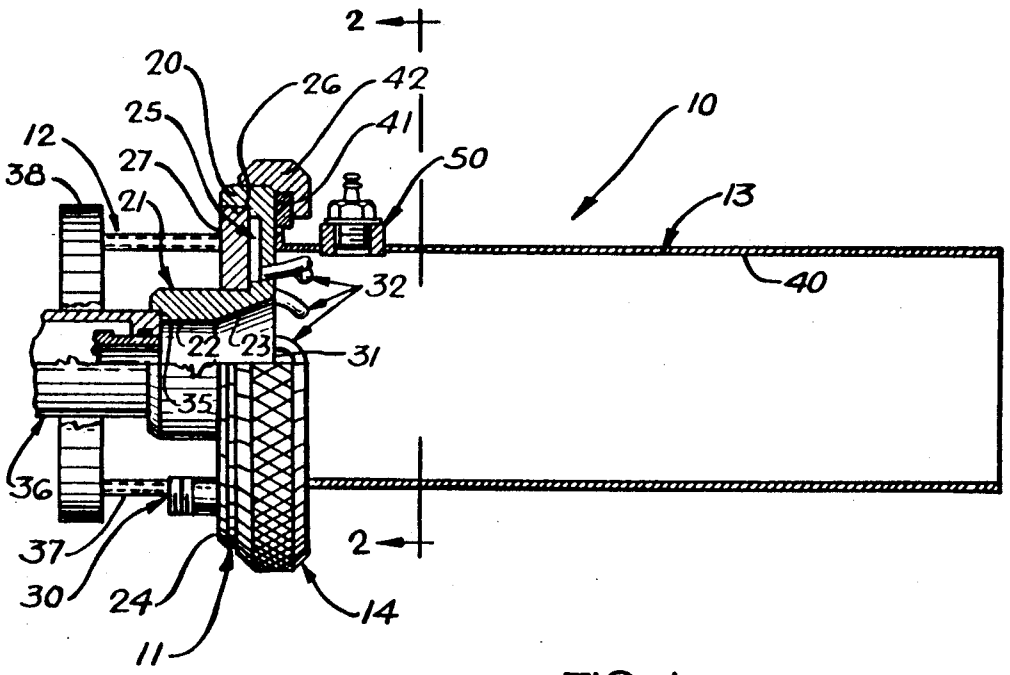
FIG. 1 is an enlarged side elevation, with parts in section, of a shroud apparatus according to this invention.

Turning to the features of the apparatus for shielding a supersonic-velocity particle-carrying exhaust jet from ambient atmosphere, initial reference is made to FIGS. 1 and 2 which illustrate a shielding apparatus, indicated generally by numeral 10, comprising gas manifold means 11, connector means 12 for joining the manifold means 11 to the outer end of a thermal spray gun barrel, constraining tube means 13, and coupling means 14 for interjoining the manifold means 11 and constraining tube means 13 in coaxial concentric relation.

Manifold means 11 comprises an annular metal body 20 having an integral cylindrical stem portion 21 extending coaxially from one end thereof and formed with an interior cylindrical passageway 22 communicating with a coaxial expanding throat portion 23 of generally frusto-conical configuration. The manifold body 20 has external threads 24 and is machined axially inwardly of its operationally rearward face to provide an annular internal manifold chamber 25 concentric with a larger annular shouldered recess 26 receptive of an annular closure ring 27 which is pressed into recess 26 to enclose the chamber 25 in gas tight relationship. A pipe fitting 30 is threadingly coupled with the annular closure member 27 for supplying inert shield gas to chamber 25 which acts as a manifold for distributing the gas. A plurality of openings (unnumbered) are formed through the front wall 31 of the manifold body 20 to communicate with the manifold chamber 25; such openings each communicating with one of a plurality of nozzles 32 arrayed in a circular pattern concentrically about the central axis of the manifold body 20 and shown herein as tubular members extending outwardly of face 31. Twelve nozzles 32 are provided in the particular illustrated embodiment (see FIG. 2). Each nozzle 32 is formed of thin wall metal tubing of substantially 3/32 inches outside diameter having a 90° bend therein, outwardly of the manifold front wall 31. Such nozzles preferably are brazed to the manifold and positioned in a manner to direct gas emitting therefrom tangentially outward of the circle in which they are arrayed, as best illustrated in FIG. 2 of the drawings.

The opposite end of the manifold body from which the several nozzles 32 project, particularly the outer end of the cylindrical stem portion 21 thereof, is counterbored at one end of passageway 22 to provide a shouldered recess 35 receptive of the outer end of the spray gun barrel 36 so as to concentrically pilot or center the manifold on the barrel of the gun.

The annular closure member 27 of the manifold means 11 is tapped and fitted with three extending studs 37 disposed at 120° intervals to form the attachment means 12 for coupling the manifold means 11 to the spray gun barrel. In this regard, it will be noted that the studs 37 are joined to a clamp ring 38 fastened about the exterior of the spray gun barrel 36, thereby coupling the manifold means 11 tightly over the outer end of the gun barrel.

The constraining tube means 13 preferably comprises an elongated cylindrical stainless steel tube 40 having a substantially 2 inch internal diameter and fitted with an annular outwardly directed flange 41 at one base end thereof whereby the constraining tube is adapted for connection coaxially of the manifold means 11. Such interconnection with the manifold is provided by an internally threaded annular locking ring 42 which fits over flange 41 and is threadingly engageable with the external threads 24 on the manifold body 20. Preferably, the flange 41 is sealed with wall 31 of the manifold body by means of an elastomeric seal, such as an O-ring (not shown).

A glow plug ignitor 50 preferably extends through the cylindrical wall of the constraining tube 40 for igniting the combustion gases employed in the flame spray gun. Alternatively, the glow plug 50 may be located in the cylindrical hub portion 21 of the manifold means 11. Utilization of the glow plug enhances operational safety of the spray gun.

With the foregoing arrangement, it will be noted that apparatus 10 is adapted and arranged for demountable attachment to the outer end of the high-velocity, thermal spray gun. The length of the constraining tube is determined by the required spraying distance. Preferably, tube 40 is between 6–9 inches in length with the outer end thereof operationally located between ½ to 7 inches from the work surface to be coated. The provision of the several inert gas nozzles 32 and the arrangement thereof to inject inert shielding gas near the inner surface of the constraining tube 40 and in a direction tangential to such inner surface, causes the shield gas to assume a helical flow path within the tube and thereafter until it impacts the work piece whereupon it mixes with the ambient atmosphere.

Introduction of the inert gas tangentially of the inner surface of the constraining tube keeps the bulk of the gas near the constraining tube and away from the central high-velocity flame plume. This minimizes energy exchange between the particle-carrying plume and the inert gas while maintaining the inert gas concentrated about the area where the powder is being applied to a substrate. The cold inert gas also serves to reduce the temperature of the constraining tube to a value which allows it to be made of non-exotic materials, such as steel.

Figure 3:
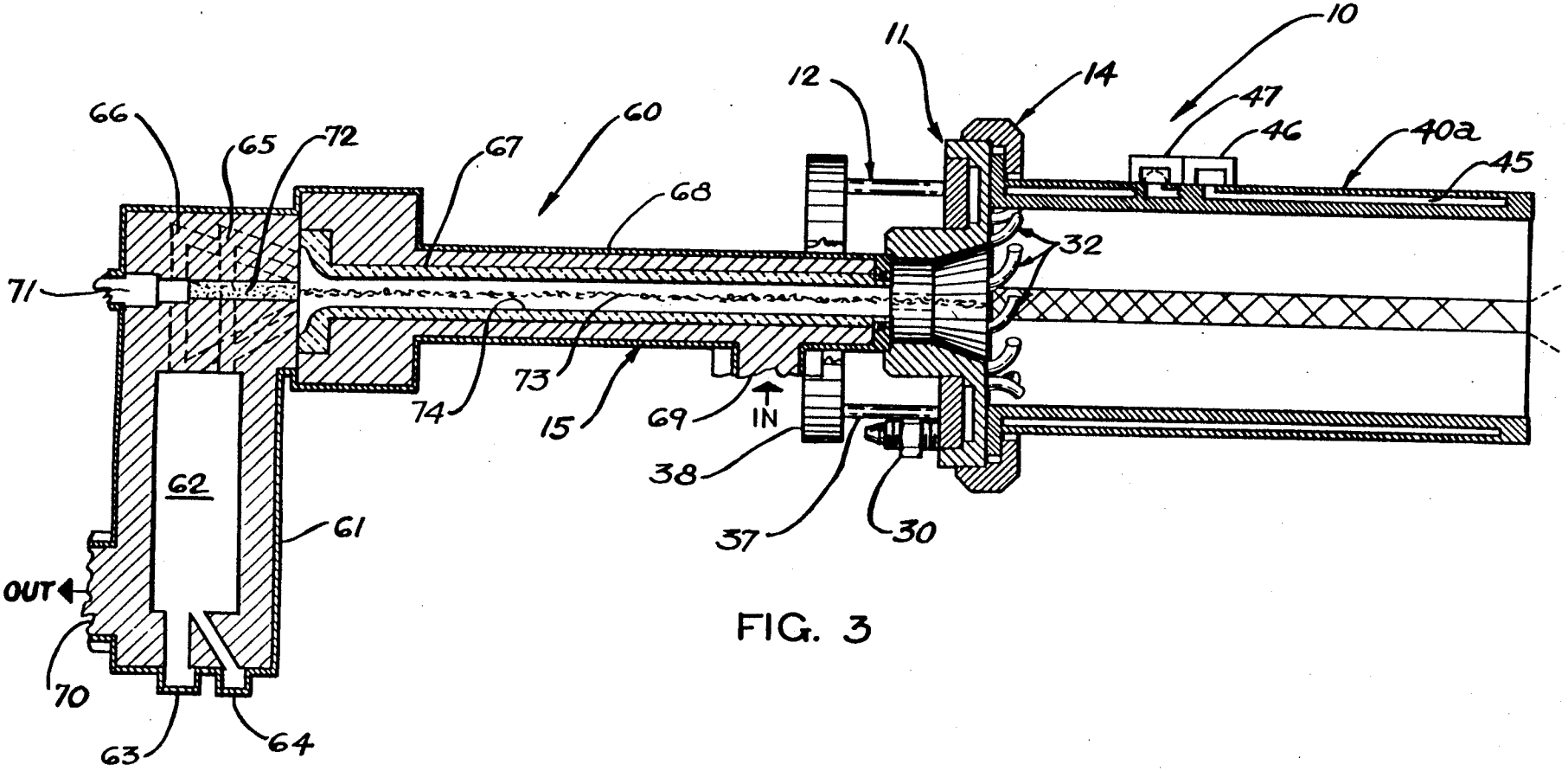
FIG. 3 is a schematic illustration of a supersonic flame spray gun assembled with a modified water-cooled shroud apparatus according to this invention.

In the modified embodiment illustrated in FIG. 3, the constraining tube 40a comprises a double-walled structure having plural internal passageways 45 which communicate with inlet and outlet fittings 46 and 47, respectively, for circulation of cooling water. In this manner, the modified tube 40a is provided with a water-cooled jacket for maintaining tube temperatures at desirable operating levels.

With further reference to FIG. 3 of the drawings, the assembly of the shroud apparatus 10 with typical supersonic-velocity thermal spray equipment will now be set forth.

As there shown, a supersonic-velocity flame spray gun of the order disclosed in U.S. Pat. No. 4,416,421 issued to James A. Browning on Nov. 22, 1983 is indicated generally by numeral 60. Flame spray guns of this order are commercially available under the trademark JET-KOTE II, from Stoody Deloro Stellite, Inc., of Goshen, Ind.

As schematically indicated, the gun assembly 60 comprises a main body 61 enclosing an internal combustion chamber 62 having a fuel gas inlet 63 and an oxygen inlet 64. Exhaust passageways 65, 66 from the upper end of the combustion chamber 62 direct hot combustion gases to the inner end of an elongated nozzle member 67 formed with a water-cooling jacket 68 having cooling water inlet 69 adjacent the outer end of the nozzle member 67. In the particular illustrated case, the circulating cooling water in jacket 68 also communicates with a water cooling jacket about the combustion chamber 62; water outlet 70 thereof providing a circulatory flow of water through and about the nozzle member 67 and the combustion chamber of the gun.

As previously indicated, the hot exhaust gases exiting from combustion chamber 62 are directed to the inner end and more particularly to the restricting throat portion of the nozzle member 67. A central passageway means communicates with the nozzle for the introduction of nitrogen or some other inert gas at inlet 71 to transport particulate or metal powders 72 coaxially of the plume of exhaust gases 73 travelling along the interior of the generally cylindrical passageway 74 of the nozzle member.

As noted heretofore, the shroud apparatus 10 is mounted over the outer end of the spray gun barrel concentrically of the nozzle passageway 74; being attached thereto by clamp ring 38 secured about the exterior of the water jacket 68. High-velocity exhaust gases carrying particulate material, such as metal powder, to be deposited as a coating on a substrate, pass coaxially along the gun nozzle, through the manifold means 11 and along the central axial interior of the constraining tube member 40a of FIG. 3 or the non-jacketed tube 40 of FIG. 2. The inert gas introduced into manifold means 11 exits via the several nozzles 32 to effect a helical swirling gas shield about the central core of the high-velocity, powder-containing exhaust jet, exiting from the outer end of the gun nozzle. As the flame exits the gun nozzle 67, it is travelling at substantially Mach 1 or 1,100 feet per second at sea level ambient, after which it is free to expand, principally in an axial direction within the constraining tube 40 or 40a, to produce an exit velocity at the outer end of the constraining tube of substantially Mach 4 or 4,000–5,000 feet per second, producing particle speeds in the order of 1,800–2,600 feet per second.

In contrast to the existing inert gas shielding systems for thermal spraying apparatus which rely heavily on flooding in the region near the flame with inert gas, the radially-constrained, helical inert gas shield provided by the apparatus of this invention avoids such waste of shield gas and the tendency to introduce air into the jet plume by turbulent mixing of the inert gas and air with the exhaust gases. In other instances, as in U.S. Pat. No. 3,470,347 issued Sept. 30, 1969 to J. E. Jackson, inert gas shields of annular configuration flowing concurrently about the jet flame have been employed. However, experience with that type of annular non-helical flow configuration for the colder inert gas shield shows marked interference with the supersonic free expansion of the jet plume by virtue of the surrounding lower velocity dense inert gas. By introducing pressurized inert gas with an outwardly directed radial component so as to direct the inert gas flow tangentially against the inner walls of the constraining tube, as in the described apparatus of this invention, minimum energy exchange occurs between the high-velocity jet plume and the lower velocity inert gas while maintaining the inert gas shield concentrated about the area where the powder is eventually applied to the substrate surface. In other words, the helical flow pattern of the inert gas shield provided by apparatus 10 of this invention shields the coating particulate from the ambient atmosphere without materially decelerating the supersonic-velocity, particle-carrying exhaust jet or plume.

To validate the operational superiority of the shroud apparatus as taught herein, high speed video analysis of the shielding apparatus without the thermal jet shows a dense layer of inert gas adjacent the constraining tube and very little inert gas in the center of the tube, which normally would be occupied by the jet gases. Similar analyses show a well established helical flow pattern when using a shroud with the 90° nozzles hereinabove described while turbulent mix flow occurs all the way across the constraining tube if a concurrent flow shroud is provided in accordance with the aforenoted Jackson U.S. Pat. No. 3,470,347. Comparative tests of no shroud, the helical flow shroud hereof, and concurrent flow shroud are tabulated below. These tests show lower total oxygen and lower oxide inclusion levels in coatings applied with the helical flow shroud. Both concurrent and helical flow shroud systems show lower total oxygen and oxide levels than in coatings achieved without any inert gas shielding.

SHROUD v. NO SHROUD

| Specimen No. | Description | Coating Oxygen Content | Material |
|---|---|---|---|
| #208A | Non-Helical Shroud (200 psi Ar) | 2.61% | Hastelloy C ™ |
| #203B | "Control" (identical to #208A except without shroud) | 3.17% | Hastelloy C ™ |
| #208B | Non-Helical Shroud (200 psi Ar) | 2.31% | Hastelloy C ™ |
| #204A | "Control" (identical to #208B except without | 3.13% | Hastelloy C ™ |

-continued

| SHROUD v. NO SHROUD | | | |
|---|---|---|---|
| Specimen No. | Description | Coating Oxygen Content | Material |
| | shroud) | | |
| #282A | Helical Shroud (200 psi Ar) | 0.54% | Hastelloy C TM |
| #281A | "Control" (identical to #282A except without shroud) | 1.91% | Hastelloy C TM |

PROCESS

The improved process of this invention is directed to the production by thermal spray equipment of extremely clean and dense metal coatings; the spray process being conducted in ambient air without the use of expensive vacuum or inert gas enclosures.

As noted heretofore, the process of this invention preferably employs a high-velocity thermal spray apparatus such as the commercially available JET KOTE II spray gun of the order illustrated in FIG. 3, for example, but modified with the shroud apparatus as heretofore described and applying particular constraints on its mode of operation.

According to this invention, hydrogen and oxygen are used as combustion gases in the thermal spray gun. The $H_2/O_2$ mass flow ratio has been found to be the most influential parameter affecting coating quality, when evaluated for oxide content, porosity, thickness, surface roughness and surface color; the key factors being porosity and oxide content. Of these two gases, oxygen is the most critical in achieving supersonic operating conditions. To this end, it has been determined that a minimum $O_2$ flow of substantially 240 liters/minute is required to assure proper velocity levels. By regulating the hydrogen to oxygen ratios to stoichiometrically hydrogen-rich levels, not all the hydrogen is burned in the combustion chamber of the gun. This excess hydrogen appears to improve the quality of the coating by presenting a reducing environment for the gun's powder-carrying exhaust. There is a limit to the amount of excess hydrogen permitted, however. For example, with $O_2$ flow at 290 liters/minute, hydrogen flow in the neighborhood of 1,050 liters/minute may cause sufficient build-up to plug the gun's nozzle and interrupt operation.

By utilizing hydrogen and oxygen as combustion gases wherein the gases are fed at pressures in excess of 80 psi to obtain oxygen flow rates between 240–290 liters/minute (270 liters/minute preferred) and $H_2/O_2$ mass flow rates in the ratio of 2.6/1–3.8/1, the gun's combustion exhaust gases are of sufficient velocity to accelerate the metal powders to supersonic velocities (in the order of 1,800–2,600 feet per second) and produce highly dense, low-oxide metal coatings of superior quality on a substrate.

Powder particle size is maintained within a narrow range of distribution normally between 10 microns and 45 microns. Starting oxygen content of the powder is maintained at less than 0.18% by weight for stainless steel powder and 0.06% for Hastelloy C TM metal alloy. Proper exhaust gas velocities are established by a distinct pattern of shock diamonds in the combustion exhaust within the constraining tube 40 of the apparatus as heretofore described, exiting from the constraining tube at approximately 4,000–5,000 feet per second. Powder carrier gas preferably is nitrogen or other inert gas at a flow rate of between 35 to 90 liters per minute, while the inert shroud gas is preferably nitrogen or argon at 200–250 psi.

It is preferred that the gun be automated to move relative to the substrate or work piece to be coated at a rate in the order of 30 to 70 feet per minute and preferably 50 feet per minute, with a center line spacing between bands of deposited materials between ⅛ and 5/16 inches.

The distance from the tip of the gun nozzle to the substrate preferably is maintained between 6.5 and 15 inches with the distance between the outer end of the shroud's constraining tube and the work piece being in the order of one ½ to 7 inches; this latter distance being referred to in the art as "stand off" distance. Preferred shroud length (manifold plus constraining tube) is in the range of 6–9 inches.

Conventional thermal spray metal coatings, such as produced by flame, wire arc, plasma, detonation and JET KOTE II processes, typically exhibit porosity levels of 3% or higher. Normally, such porosity levels are in the range of 5–10% volume as measured on metallographic cross-sections. Additionally, oxide levels are normally high, typically in the range of 25% by volume and at times up to 50% by volume. The coating structures typically show non-uniform distribution of voids and oxides as well as non-uniform bonding from particle to particle. Banded or lamellar structures are typical.

Figure 4:
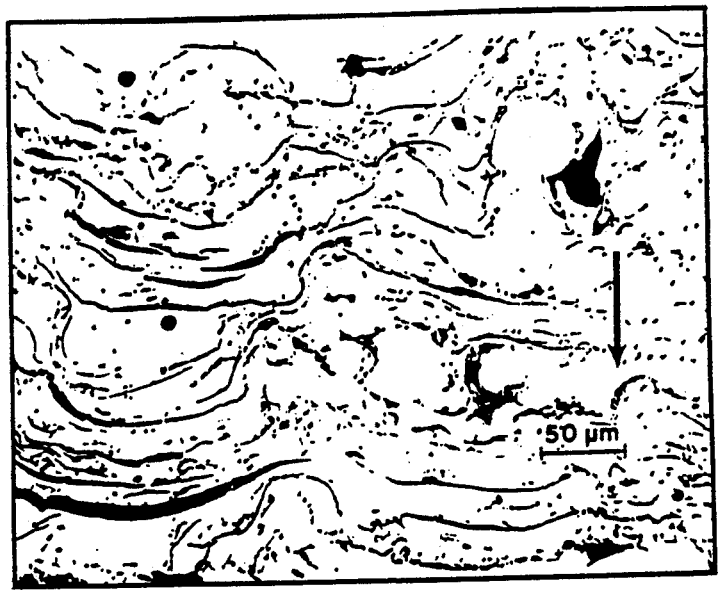
FIGS. 4–8 are a series of photomicrographs illustrating comparative characteristics of flame spray coatings.
Figure 5:
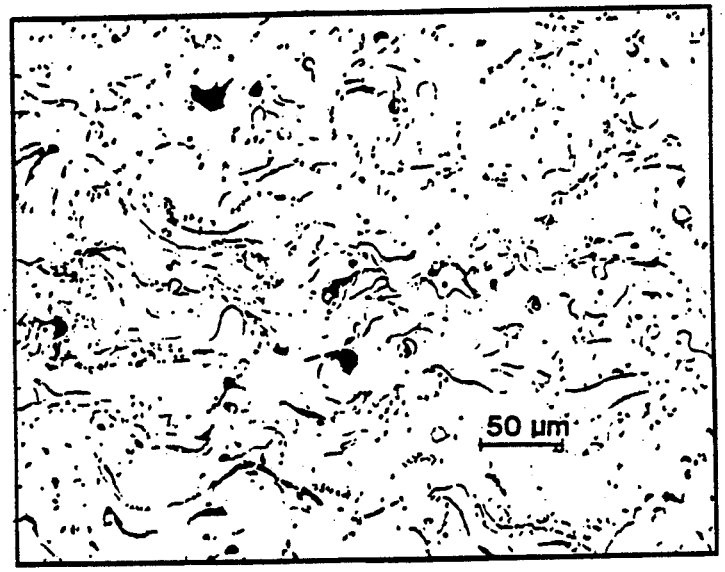
Figure 6:
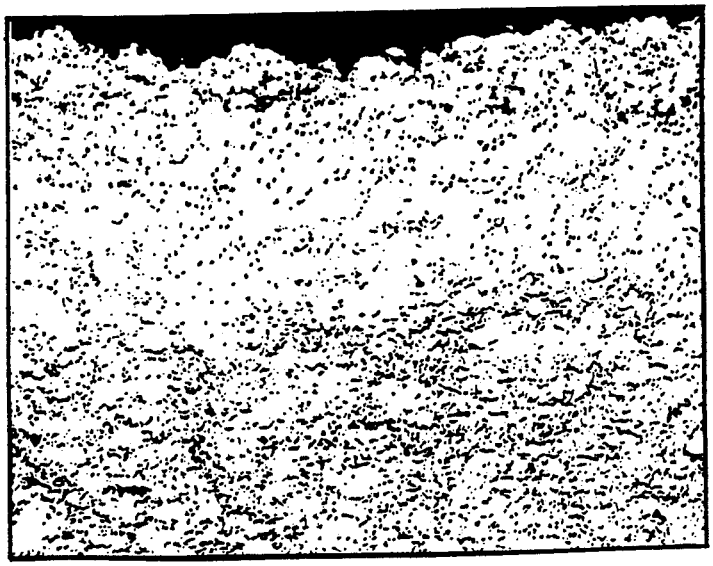

With particular reference to FIGS. 4–6 of the drawings, the aforenoted characteristics of conventional thermal spray coatings are illustrated.

The photomicrograph of FIG. 4 represents a metallographically polished cross-section of a 316L stainless steel coating produced by wire arc spraying. Large pores can be seen as well as wide gaps between bands of particles. Large networks of oxide inclusion also can be observed.

FIG. 5 represents a similar example of a Hastelloy C TM metal alloy (nickel-base alloy) coating produced by conventional plasma spraying in air. A similar banded structure with porosity and oxide networks is obvious.

FIG. 6 illustrates an example of a 316L stainless steel coating produced by the JET KOTE II process in accordance with U.S. Pat. No. 4,370,538, aforenoted, using propylene as the fuel gas. The resulting coating exhibits a non-homogeneous appearance and a high volume fraction of oxide inclusions.

Figure 7:
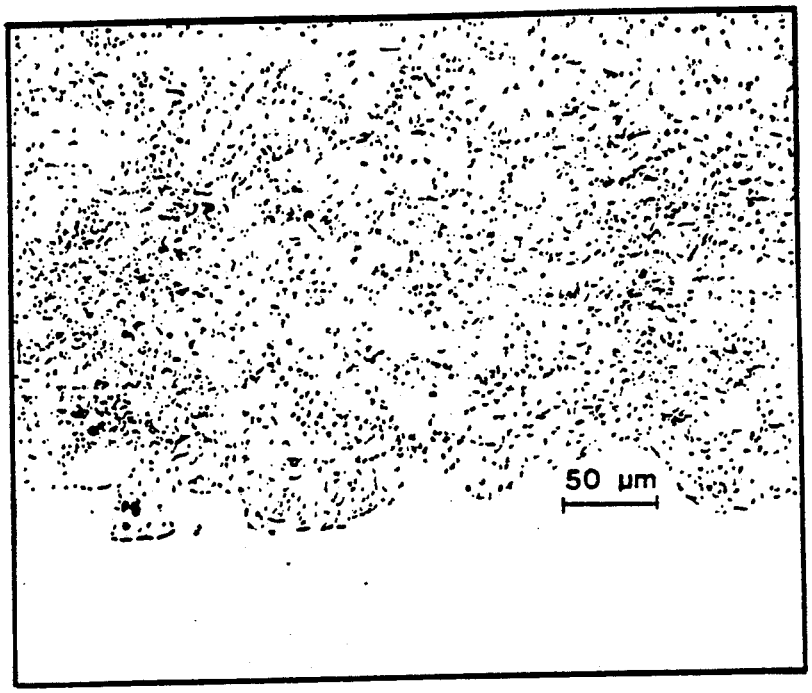
Figure 8:
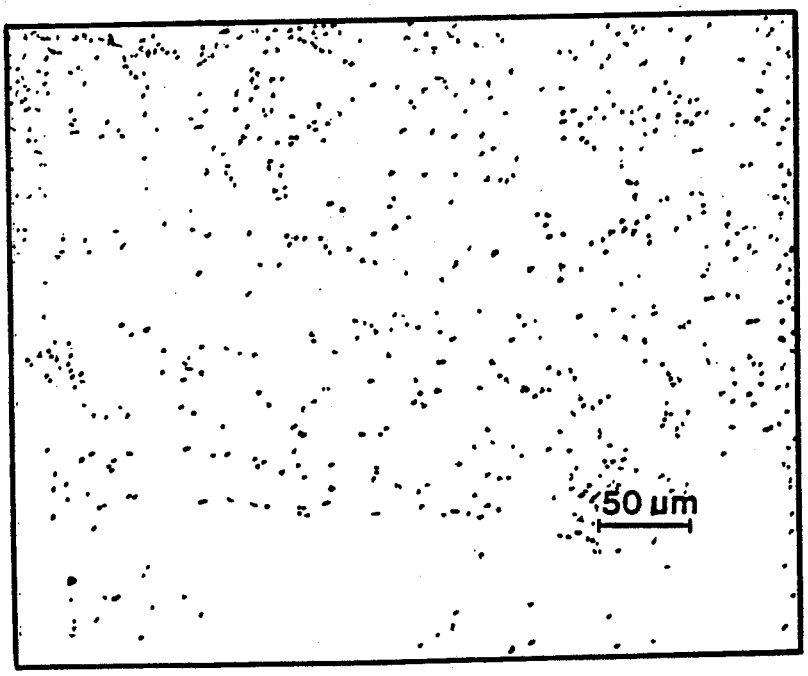

Significant improvements in density, cleanliness and uniformity of metal coating results from use of the hereinabove described process of this invention as shown in FIGS. 7 and 8.

FIG. 7 shows a metallographically polished cross-section of a Hastelloy C TM metal alloy coating produced without an inert gas shroud, but otherwise following the described process limitations as set forth. The total porosity and oxide level has been reduced, and the oxides are discrete (nonconnected).

In comparison with FIG. 7, FIG. 8 shows a comparative cross-section of a Hastelloy C TM metal alloy coating produced by the hereinabove described process using a helical flow inert gas shroud of argon gas. The total volume fraction of porosity and oxide inclusion in the coating of FIG. 8 has been further reduced to less than 1%.

Thermal spray coatings produced in accordance with the process hereof provide significantly more uniform, dense, less brittle, higher quality, protective coatings than obtainable by conventional prior art thermal spray methods. Advantageously, the process of this invention may be carried out in ambient air without the need for expensive vacuum or inert gas enclosures. Due to the nature of the shrouding apparatus, the spray gun can be made portable for use in remote locations.

The following example illustrates the unique character of coatings achieved by means of the invention. References made in this example to one or more test coating materials should not be construed as limiting the type of coating materials which may be used in connection with the method and apparatus of the invention. Rather, test coating materials were selected primarily on the basis of their common use in industrial equipment applications, particularly in corrosive processes.

COATING PROPERTIES EXAMPLE

Coatings of 316L stainless steel and Hastelloy C TM metal alloy were applied to 1018 steel substrate plates by means of the apparatus and process described herein. The coatings were applied in an air atmosphere at ambient pressure. Application surfaces of the steel substrate plates were prepared to receive the coatings using conventional cleaning and roughening techniques. Sample coupons were sawed from coated substrate plates.

Prior to the invention, it was generally thought that the most dense and oxide-free metal spray coatings could be achieved using inert-chamber, plasma arc spray techniques. For comparison purposes, coatings of 316L stainless steel and Hastelloy C TM metal alloy were applied to steel substrate plates using inert-chamber, plasma arc spray techniques. Five atmospheres were used:

| Percent Oxygen Content |
|---|
| 28.0 (air atmosphere) |
| 10.0 |
| 1.0 |
| 0.1 |
| and 0.003 or less |

Substrates comprised 1018 steel plates with application surfaces prepared prior to coating by cleaning and roughening. Sample coupons were sawed from coated substrate plates.

Image analysis and oxygen analysis of the coating compositions prepared by means of the invention and by means of inert-chamber, plasma arc spray techniques in various atmospheres were then performed.

Specimens were prepared for image analysis by cutting sections of each type of coupon, mounting these sections so that cross-sectional surfaces were exposed, then polishing the exposed surfaces. Struer's Abramatic metallographic polishing equipment and Program No. 7, a five-step automated polishing process, were used to prepare specimen surfaces for image analysis. Magnified images of the cross-sectional surfaces were then examined to determine the "Percent Area Defects". This is the percentage of the surface area examined that comprised oxide inclusions or porosity (voids) in the coatings. The analysis was performed using an Image Technology Corporation Model 3000 image analyzer. An Olympus BH-2 microscope was used to magnify the coatings 500 times. The threshold level for detection was set at 210. Forty surface area defect measurements were made at different representative areas of each cross-sectional coating area. High, low and mean measurements ("Perfect Area Defect" represents the mean) and the standard deviation for each analysis set appear in the following table:

| Specimen | Percent Area Defects | Standard Deviation | High | Low |
|---|---|---|---|---|
| HASTELLOY C TM - IMAGE ANALYSIS | | | | |
| Invention | 0.30 | .11 | .55 | .16 |
| Plasma Arc <30 ppm $O_2$ | 2.10 | .83 | 5.82 | .87 |
| Plasma Arc 10,000 ppm $O_2$ | 5.12 | 1.43 | 9.81 | 2.84 |
| Plasma Arc 100,000 ppm $O_2$ | 20.33 | 10.74 | 53.06 | 9.51 |
| Plasma Arc Air | 18.12 | 4.76 | 29.86 | 12.70 |
| 316L STAINLESS STEEL - IMAGE ANALYSIS | | | | |
| Invention | 1.09 | .17 | 1.37 | .66 |
| Plasma Arc <30 ppm $O_2$ | .81 | .41 | 2.23 | .29 |
| Plasma Arc 1,000 ppm $O_2$ | 9.19 | 4.89 | 29.10 | 2.27 |
| Plasma Arc 10,000 ppm $O_2$ | 11.35 | 4.93 | 24.76 | 2.80 |
| Plasma Arc 100,000 ppm $O_2$ | 29.15 | 12.97 | 67.04 | 12.41 |
| Plasma Arc Air | 27.91 | 9.36 | 53.15 | 14.82 |

Specimens were prepared for oxygen analysis by trimming small pieces of coating material from each sample coupon, then heating these particles inside a graphite crucible in a helium atmosphere. The electric current used to heat specimens was effective to fuse any free oxygen or oxygen released from metal oxides present in the specimen with carbon from the graphite. The resulting carbon dioxide, representative of the amount of oxygen in the specimen, was then detected using a Model TC-136 Oxygen/Nitrogen Determinator made by LECO of St. Joseph, Mich. The LECO-136 employs gas chromatography techniques. Using these oxygen determinations, the following weight percentages of oxygen were calculated for each specimen analyzed:

| Specimen | Percent Oxide |
|---|---|
| HASTELLOY C TM - OXIDE ANALYSIS | |
| Invention | 0.54 |
| Plasma Arc <30 ppm $O_2$ | 0.47 |
| Plasma Arc 10,000 ppm $O_2$ | 0.91 |
| Plasma Arc 100,000 ppm $O_2$ | 3.21 |
| Plasma Arc Air | 3.65 |
| 316L STAINLESS STEEL - OXIDE ANALYSIS | |
| Invention | 0.19 |
| Plasma Arc <30 ppm $O_2$ | 0.58 |
| Plasma Arc 1,000 ppm $O_2$ | 1.06 |
| Plasma Arc 10,000 ppm $O_2$ | 0.77 |
| Plasma Arc 100,000 ppm $O_2$ | 4.04 |
| Plasma Arc Air | 5.28 |

It is clear from the above analyses that the coatings achieved using the invention in an air atmosphere compare favorably to inert-chamber, plasma arc coatings made in atmospheres containing less than 30 ppm oxygen. As for plasma arc coatings made in an air atmosphere, or even in an inert-chamber atmosphere containing only 10,000 ppm oxygen, it was shown that the coatings achieved using the invention are substantially denser and contain fewer oxides.

Those skilled in the art of thermal spray deposition of metal coatings will appreciate the very great advantage of being able to achieve in an air atmosphere coatings as dense and oxide free as those previously requiring inert-chamber controlled atmospheres. Except for relatively small pieces, such as jet engine rotor blades, inert-chamber techniques are not practical or cost effective. Using the invention, however, dense, essentially oxide-free metal layers can be deposited in an atmosphere containing ambient air having an oxygen content above 10%. Many applications for such a coating can be imagined.

The following examples illustrate the types of applications for coatings produced by the method and apparatus of the invention. In each of the following examples, reference is made to one or more coating materials used in connection with the method and apparatus of the invention. Such references should not be construed as limiting the type of coating materials which may be used. Many industrially important metals or metal alloys may be suitable for use, although attributes of high density, oxide coatings achieved using the invention are particularly important in corrosive environments where stainless steel, Stellite TM and Hastelloy TM metal alloys are commonly used.

COATING APPLICATION EXAMPLE - CORROSION BARRIER

Corrosion tests were conducted on sets of two 4-inch square carbon steel plates, coated on one side. The coated side of each set of plates was placed into intimate contact with various test solutions. Conventional thermal spray coating samples applied in ambient air atmospheres quickly fail in acid solutions, however, samples coated by the apparatus and method of the invention have been shown to protect the carbon steel for long periods of time. The following test results represent successful exposure to acid environments without failure. The environments tested are very corrosive to the carbon steel substrate, but not to the coating materials.

| Coating | Environment | Time Elapsed |
|---|---|---|
| Hastelloy C TM | 1.0% HCl (95° F.) | >10 months |
| Hastelloy C TM | 2.0% $H_2SO_4$ (boiling) | >8 months |
| 316 Stainless Steel | 99.9% acetic (room temp) | >4 months |
| Hastelloy C TM | 20.0% acetic (room temp) | >4 months |

Corrosion barrier coatings produced by the method and apparatus of the invention have many advantages over previous thermal spray coatings applied in ambient air atmospheres. Such improved coatings are suitable for corrosive environments, including surfaces exposed to a combination of corrosion and erosion or wear. The process is portable and can be used in remote locations. Further, this process represents a cost effective alternative to other corrosion control methods, including weld overlays, detonation cladding and use of solid alloy construction.

The corrosion barrier coatings achieved by the apparatus and method of the invention can be integrated into the original fabrication of equipment, or as illustrated below as a repair or maintenance technique for existing equipment.

COATING APPLICATION EXAMPLE—EQUIPMENT REPAIR

Two reactor vessels, 70 feet high and 10 feet in diameter, have weld overlays with cracks. The vessel walls are 6 inches thick and composed of 2¼-Cr, 1-Mo steel. The overlays are ⅜ inch thick and of 347 stainless steel. The overlays had become embrittled and showed a multitude of cracks and crack networks near the bottom heads. Attempts to weld repair the cracks were unsuccessful because the heat induced in the areas around the weld caused these areas themselves to crack.

Test plates were prepared to simulate this potential repair application for the method and apparatus of the invention. The test plates included ⅜ inch weld overlays that were heat treated to the same embrittled state as the reactor vessels. Crack repairs are typically effected by grinding cracks out then protecting any exposed base metal. In this case, grooves were machined through test plate overlays into the base metal so that coatings could be sprayed directly on the base metal. Test plates were then placed in the reactor vessels and exposed to the harsh reactor environment to see whether crack repair coatings could protect the base metal without inducing further cracking. The vessels operate at 2,400 psig and 850° F., with 70% $H_2/H_2S$. Coatings of 316L stainless steel were applied to test plates using the method and apparatus of the invention, as well as conventional plasma arc and JET KOTE II techniques. After one year of exposure, the plasma sprayed JET KOTE II coatings were found to be either missing or fully sulfidized. Missing coatings probably lacked sufficient bonding to the substrate necessary to withstand thermal cycling. Sulfidized coatings were analyzed revealing that the sulfur containing atmosphere penetrated the plasma applied coatings and attacked the substrate. Coatings applied using the method and apparatus of the invention, however, were intact and evidenced corrosion of approximately 0.001 inch. The substrate was fully protected.

There are several advantages attributable to use of coatings achieved by means of the method and apparatus of the invention for repairing the walls of large vessels. The controlled heat input eliminates the need for costly pre-and post-heat treatments to stress relieve or to soften a hardenable material. Small or large areas can be covered by this process. The coating itself can be repaired. Where sensitive metallurgical conditions exist in an overlay, repairs can be made without induced heat effects. Where unexpected corrosion in clad or unprotected walls is present, these coatings can be applied either locally or over broad areas for protection. As a crack repair procedure, in situations such as described in the example, this process may be the only alternative to replacing the vessel.

COATING APPLICATIN EXAMPLE—TANK CAR REPAIR

Carbon steel tanks cars used to transport liquid sulfur from stockpiles and gas plant, refinery or other sulfur recovery units are often subject to corrosive attack in normal use. It is thought that such attack is attributable to the formulation of corrosive material resulting from the reaction between moisture or water and sulfur or sulfur residue inside the tank cars. Coatings were applied by means of the method and apparatus of the invention to test areas inside two such tank cars which were then returned to service. In each case, three patches of 1.5 square foot areas were applied; two patches were Hastelloy C TM metal alloy and the remaining patch was 316L stainless steel. The test areas were prepared by sandblasting prior to the application of coating material. In the first case, test patches were exposed to actual service conditions for 20 months. In the second case, the test lasted 18 months. In both cases, all three test patches demonstrated excellent resistance to corrosion and proved to be effective corrosion barriers to the underlying substrate. It is believed that coatings made using the invention may find wide application to a variety of corrosive tank car and tank truck services, both to effect repairs and to provide protective barriers against further corrosion.

COATING APPLICATION EXAMPLE—IMPROVED GAS WELL TUBULARS

The corrosion barrier coating achieved by the method and apparatus of the invention can be used to protect the ends of gas well tubing which experience degradation from a corrosion-erosion mechanism in gas well service. The erosion is caused by cavitation from liquids condensing on the tube ends as gas flows through the tube string at high velocities. This erosion causes pits to form on the inner diameter of the tube ends at the edge of the tube. The result is the failure of the tubing, a failure which requires replacement of the entire tubing string for remedy.

The problem occurs in many gas producing regions, including Trinidad, Oklahoma, Wyoming and the Texas gulf coast. While corrosives involved at various locations may be different, the effect is similar. For instance, $H_2S$ is the primary corrosive in Texas gulf coast areas and the normal tubular material there is 13-Cr stainless steel. Carbon dioxide is the primary corrosive in Western Wyoming and the normal tubular material there is N-80 carbon steel. Pitting attack on the inner edge of the tubing is found in both regions.

The end of the tube to be coated is undercut to accommodate the coating build up and the sharp corner is rounded off. The area to be sprayed is grit-blasted. Coating is applied using the method and apparatus of the invention in connection with a spray gun manipulator programmed to position and move the spray gun in the pattern that most nearly maintains the gun in a position that is perpendicular relative to the surface being coated. Excess coating may be applied to allow for surface finishing. Final coating thickness was approximately 0.2 inches.

Cavitation testing using full ASTM test conditions showed excellent performance of Hastelloy C TM -276 metal alloy applied by means of the method and apparatus of the invention. Conventional plasma arc coatings fall apart under identical test conditions.

By means of the apparatus and methods of the invention, it is possible to coat a critical portion of gas well tubulars to prevent corrosion-erosion degradation. This method is more cost effective than alternative corrosion-erosion prevention methods which include redesigning tubular joints, using more corrosion-resistant materials, using corrosion inhibitors or chromizing the entire tube.

Having described this invention, it is believed that those familiar with the art will readily recognize and appreciate the novel advancement thereof over the prior art and further will understand that while the same has been described in association with a particular preferred embodiment, the same is susceptible to modification, change and substitution of equivalents without departing from the spirit and scope thereof which is intended to be unlimited by the foregoing except as may appear in the following appended claims.

That which is claimed is:

1. A method of depositing a layer on a substrate in an atmosphere containing ambient air having an oxygen content above about 1,000 parts per million comprising directing a high velocity jet stream of hot gases carrying metal particles at said substrate through a shroud effective to maintain a helically flowing stream of inert gas substantially concentrically around the particle carrying jet stream so as to essentially isolate said particle carrying jet stream from said atmosphere, wherein the volume of voids and oxide inclusions in said layer represents less than about 1% of said layer's volume, and oxide in said layer represents less than about 1% of the layer by weight.

2. The method of claim 1, wherein said metal particles comprise fine particles of a metal alloy selected from the group consisting of stainless steel, Stellite TM and Hastelloy TM metal alloys.

3. The method of claim 2, wherein said layer comprises a corrosion barrier effective to protect a less corrosion resistant substrate from erosion and corrosion.

4. The method of claim 3, wherein said substrate comprises the internal shell of a process vessel.

5. The method of claim 3, wherein said substrate comprises the internal wall of the end of a tubular member.

6. The method of claim 3, wherein said substrate comprises the internal shell of a tank car.

7. The method of claim 1, wherein said layer replaces material lost or removed from said substrate.

8. The method of claim 6, wherein said layer is effective to repair substrate that has been corroded or eroded.

9. The method of claim 6, wherein said layer is effective to repair substrate that has developed cracks.

* * * * *